US005154980A

United States Patent [19]

Koshizuka et al.

[11] Patent Number: 5,154,980

[45] Date of Patent: Oct. 13, 1992

[54] HEAT TRANSFER RECORDING MEDIUM

[75] Inventors: Kunihiro Koshizuka, Hachioji; Takao Abe, Tokyo, both of Japan

[73] Assignee: Konica Corporation, Tokyo, Japan

[21] Appl. No.: 637,795

[22] Filed: Jan. 7, 1991

[30] Foreign Application Priority Data

Jan. 17, 1990 [JP] Japan ..... 2-7820

[51] Int. Cl.[5] ..... B41M 5/26

[52] U.S. Cl. ..... 428/484; 428/195; 428/488.4; 428/216; 428/336; 428/913; 428/914

[58] Field of Search ..... 428/195, 411.1, 484, 428/488.1, 488.4, 913, 914, 336, 216

[56] References Cited

U.S. PATENT DOCUMENTS 4,818,591 5/1989 Kitamura et al. ..... 428/914
4,927,693 5/1990 Koshizuka et al. ..... 428/914
4,970,119 11/1990 Koshizuka et al. ..... 428/488.4

*Primary Examiner*—Pamela R. Schwartz
*Attorney, Agent, or Firm*—Finnegan, Henderson, Farabow, Garrett and Dunner

[57] ABSTRACT

There is disclosed the heat transfer recording medium having an excellent resolution and capable of forming printed images having improved resistance to abrasion and solvent. The recording medium is characterized by the peeling layer containing amide wax.

18 Claims, No Drawings

HEAT TRANSFER RECORDING MEDIUM

FIELD OF THE INVENTION

The present invention relates to a heat transfer recording medium, specifically to a heat transfer recording medium having higher resolution and capable of producing a printed image having improved resistance to abrasion and solvents.

BACKGROUND OF THE INVENTION

Heat transfer recording mediums are widely employed in bar code printers, word processors and facsimiles, since they can easily produce clear printed images.

Heat transfer recording mediums employed especially in bar code printers are required to have higher resolution to the bars in printing bar codes with a line printer. However, none of conventional heat transfer recording mediums satisfy this requirement.

Bar codes are read out by moving a pen scanner over printed bar code images which are formed with a heat transfer medium. Accurate readout of information cannot be achieved if bar codes printed on articles are blurred or effaced by rubbing with foreign materials during transportation of the articles. Further, repeated readout may result in abrasion of bar codes with a pen scanner.

Computers are widely utilized for control of automobile parts, and a bar code system is used for data entry. Bar codes formed with conventional heat transfer recording mediums have poor resistance to solvents. Therefore, in assembly or repair shops of automobiles where solvents often adhere to bar codes printed on automobile parts, there can be such a problem that bar codes are blurred or effaced due to solvents adhering thereto.

Under such circumstances, there is a demand for a heat transfer recording medium capable of producing a printed image having excellent resistance to abrasion and a solvent, while it is generally known that the improvement in the resistance of a printed image to abrasion and solvents is liable to deteriorate image quality, which results in lowering resolution to the bars in bar codes.

SUMMARY OF THE INVENTION

The object of the present invention is to provide a heat transfer recording medium capable of producing a printed image having improved resistance to abrasion and solvents as well as a higher resolution.

The above object can be attained by a heat transfer recording medium comprising a support, provided thereon a peeling layer and a colorant layer in sequence, wherein the peeling layer contains amide wax.

DETAILED DESCRIPTION OF THE INVENTION

One of the important features of the invention is the provision of a peeling layer containing amide wax on a support.

In the invention, the amide wax contained in the peeling layer makes it possible not only to improve the resolution of the recording medium to the bars in printing bar codes with a line printer, but also to improve the resistance of a printed image to abrasion and solvents without lowering the resolution.

In the invention, the amide wax is defined by the compound having an amide bond (—CO—NH—), the weight average molecular weight of 200 to 20,000, preferably 300 to 3,000, and the melting point of 50° to 160° C., preferably 60° to 150° C.

The preferred amide wax is represented by the following formula (I):

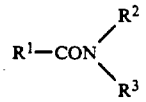

wherein $R^1$ represents an alkyl group and $R^2$ and $R^3$ each represent an alkyl group and a hydrogen atom, provided that $R^2$ and $R^3$ may be either identical or different.

The examples thereof are aliphatic amides such as caproylamide, caprylylamide, caprylamide, laurylamide, myristylamide, palmitylamide, hexylamide and stearylamide; and N-methyl aliphatic amides such as amylmethylamide, caproylmethylamide, caprylylmethylamide, caprylmethylamide, laurylmethylamide, myristylmethylamide, cetylmethylamide, stearylmethylamide, aralkylmethylamide and behenylmethylamide. Of them, preferred are aliphatic amides and N-methyl aliphatic amides each having the aliphatic group with 12 or more carbon atoms. Especially preferred is the latter.

The preceding amide waxes may be employed either singly or in combination.

The amide wax can be prepared by the copolymerization reaction of dibasic acid and diamine, the self-condensation reaction of ω-amino acid, or the ring-opening polymerization of lactam compounds.

The amide wax may be N-alkylated at the amide site to control melting point.

For the N-alkylation, N-alkylamine or N,N'-dialkylamine, or ω-N-alkylamino acid is used in combination with alkyl- or dialkylamine, or ω-amino acid.

One example is a ω-N-methylamino undecannic acid polymer (Mw : about 5,000, mp : 60° C.), which is commercially available as HT-W series manufactured by Sanwa Chemical Co., Inc.

The amide wax usable in the invention may be a compound in which a polyamide chain is blocked or grafted; a compound having an alkyl or amide group at the terminal; or a compound partially having an ether bond, an amide bond or a urethane bond in its primary or side chain.

The peeling layer contains the amide wax of not less than 10 wt %, preferably not less than 20 wt %.

In the invention, the peeling layer contains preferably polyamide in combination with the amide wax.

The use of polyamide together with the amide wax can further improve the durability of a printed image.

The examples of usable polyamides are those having two or more amide bonds, such as nylon 6, nylon 66, nylon 610, nylon 11, nylon 12, copolymerized nylon and other polyamides.

These polyamides may be employed either singly or in combination.

Polyamide is added to the peeling layer in a proportion of 1 to 50 wt %, preferably 2 to 20 wt %.

In the invention, the peeling layer is substantially colorless and contains no significant amount of a colorant.

The peeling layer can be provided on a support by a hot-melt coating method, an aqueous coating method, an organic solvent method or a solvent dispersion method. The amide wax may be used after dispersing it in a solvent.

The dry thickness of the peeling layer is 0.1 to 5.0 μm, preferably 0.3 to 4 μm.

At least one colorant layer is provided on the peeling layer directly or via an intermediate layer.

In the invention, the colorant layer normally contains a colorant, a fusible substance and a thermoplastic resin.

Usable colorants are pigments such as inorganic and organic pigments, and dyes.

The examples of the inorganic pigments are titanium dioxide, carbon black, zinc oxide, Prussian blue, cadmium sulfide, iron oxide, and chromates of lead, zinc, barium and calcium.

The examples of the organic pigments are pigments of azo, thioindigo, anthraquinone, anthanthrone, and triphenyl-dioxazine; vat pigments; phthalocyanine pigments such as copper phthalocyanine and derivatives thereof; and quinacridone pigments.

The examples of the organic dyes are acid dyes, direct dyes, dispersion dyes, oil-soluble dyes and metal-containing oil-soluble dyes.

The content of the colorant in the colorant layer is normally 5 to 35 wt %, preferably 10 to 25 wt %.

The examples of the fusible substance are vegetable waxes such as carnauba wax, Japan tallow, auricury wax and esparto wax; animal waxes such as bees wax, insect wax, shellac wax and spermaceti; petroleum waxes such as paraffin wax, microcrystal wax, polyethylene wax, ester wax and acid wax; mineral wax such as montan wax, ozocerite and ceresin; higher fatty acids such as palmitic acid, stearic acid, marganic acid and behenic acid; higher alcohols such as palmityl alcohol, stearyl alcohol, behenyl alcohol, marganyl alcohol, myricyl alcohol and eicosanol; higher fatty esters such as cetyl palmitate, myricyl palmitate, cetyl stearate and myricyl stearate; amides such as acetamide, propionic amide, palmitic amide, stearic amide and amide wax; and higher amines such as stearylamine, behenylamine and palmitylamine.

These substances may be employed either singly or in combination. Of them, especially preferred is wax having the melting point of 50° to 120° C. The content of the fusible substance in the colorant layer is 10 to 95 wt %.

The examples of the thermoplastic resin are polyester resins, polyolefin resins, acryl resins, polyvinyl chloride resins, rosin resins, petroleum resins, ionomer resins, rosin derivatives such as rosin-maleic acid resin, rosin-phenol resin and hydrogenated rosin, phenol resins, terpene resins, cyclopentadiene resins, and aromatic hydrocarbon resins.

These resins may be employed either singly or in combination.

Of them, preferred are acryl resins and ethylene copolymers.

The above thermoplastic resins have the softening points ranging from 50° to 150° C.

The content of the thermoplastic resin in the colorant layer is in the range of 5 to 30 wt %, preferably 10 to 15 wt %.

The colorant layer may further contain a surfactant such as a compound having a polyoxyethylene chain, organic or inorganic fine particles such as a metal powder and silica gel, and oils such as flaxseed oil and mineral oil.

The colorant layer can be provided by the same methods as those used for coating the peeling layer.

The thickness of the colorant layer is 0.3 to 8 μm, preferably 0.5 to 5.0 μm.

The support employed in the invention is required to have improved thermal resistance and dimension stability.

The examples thereof are paper such as ordinary paper, condenser paper, laminated paper and coated paper; resin films such as a polyethylene film, a polyethylene terephthalate film, the polystyrene film, a polypropylene film and a polyamide film; a composite support of paper and a resin film; and a metal sheet such as aluminum foil.

The thickness of the support is not more than 30 μm, preferably 2 to 6 μm. The thickness exceeding 30 μm is liable to lower thermal conductivity, resulting in deterioration of printed image quality.

There may be provided a backing layer on the reverse side of the support to prevent sticking.

In preparing the heat transfer recording medium of the invention, the peeling layer and the colorant layer are provided in this sequence on the support, followed by drying and surface-smoothing treatment. Then, the recording medium is cut to such prescribed shapes as a broad tape for a line printer and a ribbon for a type writer.

The heat transfer recording medium of the invention can be heat-transferred by conventional methods.

EXAMPLES

The present invention will be described in more detail according to the following working examples and comparison.

EXAMPLE 1

The following components were applied on a 4.5 μm-thick polyethylene terephthalate film by the solvent dispersion method to provide the peeling layer with the dry thickness of 3 μm.

| Peeling layer composition | |
|---|---|
| Stearyl methylamide (melting point: 80° C.) | 95 wt % |
| Polyamide | 5 wt % |

Then, the following components were applied on the peeling layer by the solvent dispersion method to provide the colorant layer with the dry thickness of 2 μm, whereby the heat transfer recording medium of the invention was prepared.

| The colorant layer composition | |
|---|---|
| Paraffin wax | 50 wt % |
| Ethylene-vinyl acetate copolymer (vinyl acetate content: 35 wt %) | 20 wt % |
| Rosin | 10 wt % |
| Carbon black | 20 wt % |

The above heat transfer recording medium was subjected to printing on a fine paper (Beck smoothness: 2 sec) with a bar code printer (manufactured by Toshiba) to evaluate the resolution of the recording medium and the resistance of printed images (bar code) to abrasion and solvents.

The results are shown in Table 1.

The resolution and the resistance to abrasion and solvents were evaluated by the following methods:

Resolution:

The printed bar codes were visually observed to classify the rating to the following two criteria:

o: each dot printed clearly x: each dot defaced and tailing observed

Resistance to abrasion

The images (bar codes) printed on a fine paper were evaluated with the anti-abrasion tester manufactured by Konica Corporation to classify the rating to the following two criteria:

| Conditions of the evaluation: |
|---|
| Number of rubbing times: 30 |
| Load: 500 kg/cm$^2$ |
| Evaluation |
| o: legible with a bar code reader |
| x: illegible with a bar code reader |

The printed images were rubbed coming and going 10 times at the speed of 20 cm/sec and the load of 500 g/cm$^2$ with a cotton cloth containing toluene to classify the rating to the following two criteria:.

o : legible with a bar code reader x : illegible with a bar code reader

COMPARISON 1

The comparative heat transfer recording medium was prepared and evaluated in the same manners as in Example 1, except that the components for the peeling layer were replaced with paraffin wax. The results are shown in Table 1.

TABLE 1

| | Example 1 | Comparison 1 |
|---|---|---|
| Resolution | o | x |
| Resistance to abrasion | o | x |
| Resistance to solvents | o | x |

As is evident from Table 1, the heat transfer recording medium of the invention is capable of producing the printed images having higher resolution and more excellent resistance to abrasion and solvents than those of the comparative recording medium.

What is claimed is:

1. A heat transfer recording medium comprising a support, a colorant layer containing a colorant and a peeling layer between the support and the colorant layer, wherein said peeling layer contains a polyamide and 10 percent by weight or more of an amide wax of the formula:

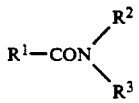

wherein $R^1$ is an alkyl group, and $R^2$ and $R^3$ are the same or different and each represents a hydrogen atom or an alkyl group, whereby resistance to abrasion and solvents is imparted to a recorded image produced upon thermal transfer.

2. A heat transfer recording medium according to claim 1, wherein $R^1$ is an alkyl group having 12 or more carbon atoms, $R^2$ is a hydrogen atom or a methyl group, and $R^3$ is a hydrogen atom.

3. A heat transfer recording medium according to claim 2, wherein $R^2$ is a methyl group.

4. A heat transfer recording medium according to claim 1, wherein the content of the amide wax in the peeling layer is 20 percent by weight or more.

5. A heat transfer recording medium according to claim 1, wherein the content of the polyamide in the peeling layer is 1 to 50 percent by weight.

6. A heat transfer recording medium according to claim 1, wherein the content of the polyamide in the peeling layer is 2 to 20 percent by weight.

7. A heat transfer recording medium according to claim 1, wherein the peeling layer has a thickness of 0.1 to 5.0 μm.

8. A heat transfer recording medium according to claim 7, wherein the thickness of the peeling layer is 0.3 to 4.0 μm.

9. A heat transfer recording medium according to claim 1, wherein the content of the colorant in the colorant layer is 5 to 35 percent by weight.

10. A heat transfer recording medium according to claim 9, wherein the content of the colorant in the colorant layer is 10 to 25 percent by weight.

11. A heat transfer recording medium according to claim 1, wherein the colorant layer further contains a fusible substance.

12. A heat transfer recording medium according to claim 11, wherein the fusible substance is a wax having a melting point of 50° to 120° C.

13. A heat transfer recording medium according to claim 1, wherein the colorant layer further contains a thermoplastic resin.

14. A heat transfer recording medium according to claim 13, wherein the thermoplastic resin is an acrylic resin or an ethylene copolymer.

15. A heat transfer recording medium according to claim 13, wherein the colorant layer has a thickness of 0.3 to 8.0 μm.

16. A heat transfer recording medium according to claim 15, wherein the thickness of the colorant layer is 0.5 to 5.0 μm.

17. A heat transfer recording medium comprising a support, a colorant layer containing a colorant and a peeling layer between the support and the colorant layer, wherein said peeling layer consists essentially of at least one polyamide and at least one amide wax of the following formula:

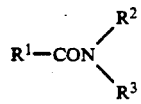

wherein $R^1$ is an alkyl group, and $R^2$ and $R^3$ are the same or different and each represents a hydrogen atom or an alkyl group.

18. A heat transfer recording medium according to claim 17, wherein $R^2$ is a methyl group and $R^3$ is a hydrogen atom.

* * * * *